US005685493A

United States Patent [19]

Grytz et al.

[11] Patent Number: 5,685,493

[45] Date of Patent: Nov. 11, 1997

[54] ELECTROMAGNETICALLY ACTUABLE INJECTION VALVE

[75] Inventors: Uwe Grytz, Bamberg; Ulrich Vieweg, Frensdorf, both of Germany

[73] Assignee: Robert Bosch GmbH, Stuttgart, Germany

[21] Appl. No.: 419,308

[22] Filed: Apr. 10, 1995

[30] Foreign Application Priority Data

Apr. 9, 1994 [DE] Germany ..... 44 12 277.2

[51] Int. Cl.[6] ..... B05B 1/30

[52] U.S. Cl. ..... 239/585.1; 336/59; 251/129.21

[58] Field of Search ..... 239/585.1, 585.5; 336/59; 251/129.01, 129.17, 129.21

[56] References Cited

U.S. PATENT DOCUMENTS 4,146,112 3/1979 Usry ..... 336/59

4,986,246 1/1991 Kessler De Vivie ..... 251/129.21

5,348,232 9/1994 Babitzka ..... 251/129.21

FOREIGN PATENT DOCUMENTS 348 786 1/1990 European Pat. Off. .

*Primary Examiner*—Robert J. Oberleitner

*Assistant Examiner*—C. T. Bartz

*Attorney, Agent, or Firm*—Kenyon & Kenyon

[57] ABSTRACT

A fuel injection valve prevents capillary flow by the provision of controlled pressure compensation. In the region of axial extension of the magnet coil, at least one radially extending transverse hole is introduced into the valve housing and this hole is covered by a diaphragm which surrounds the valve housing in the form of a ring. The diaphragm allows pressure compensation without the risk that moisture will penetrate into the interior of the valve and prevents negative capillary flows. The fuel injection valve is suitable, in particular, for use in fuel injection systems of mixture-compressing applied-ignition internal combustion engines.

10 Claims, 2 Drawing Sheets

ELECTROMAGNETICALLY ACTUABLE INJECTION VALVE

FIELD OF THE INVENTION

The present invention relates to an electromagnetically actuable fuel injection valve.

BACKGROUND INFORMATION

Numerous fuel injection valves which have an electrical connection plug by means of which the electrical contacting of a magnet coil, and hence its excitation, are achieved are already known, for example European Patent Application No. 0 348 786. Contacting per se is achieved by means of metallic contact pins which extend from the magnet coil as far as the actual connection plug and are largely surrounded by molded plastic.

However, in practice, the molded-in contact pins are not surrounded in a completely tight manner. On the contrary, very fine capillary gaps form between the contact pins and the molded plastic. Particularly under the action of heat, this effect is even further increased due to the differing coefficients of thermal expansion of plastic and metal and leads to the displacement of material.

During the operation of the internal combustion engine and the fuel injection valve, an increase in temperature in the region of the magnet coil and the connection plug is caused precisely by the internal combustion engine and also by the heating up of the magnet coil. This increase in temperature in turn increases the formation of capillary gaps. The very fine capillary gaps ensure that direct connections exist between the air enclosed between the coil former and the valve housing and the atmosphere existing outside the fuel injection valve, allowing the fuel injection valve to "breathe".

It follows that a pressure compensation between the outside atmosphere and the inner air can take place as a function of the temperature. Given an increase in temperature during the operation of the fuel injection valve, the expansion in the volume of the magnet coil and of the enclosed air ensures that the internal pressure is relieved to the outside via the capillary gaps and thus a pressure equilibrium is maintained. During cooling, the pressure compensation takes place in the opposite direction, with the result that ambient air enters the interior of the valve, high humidity, in particular, being very disadvantageous. The risk that moisture will enter the interior of the fuel injection valve is particularly high when the internal combustion engine is very vulnerable to spray, as is the case, inter alia, with rear-mounted engines of motor vehicles or when the prevailing environmental conditions are extreme. The result is corrosion on the contact pins and the coil wire, leading in an extreme case to destruction of the coil wire.

SUMMARY OF THE INVENTION

In contrast, the fuel injection valve according to the present invention has the advantage that the achievement of a controlled pressure compensation between the outside atmosphere and the coil space ensures that no moisture penetrates into the interior of the valve, thus precluding corrosion on the contact pins and the coil wire and hence destruction of the latter.

It is particularly advantageous to employ a temperature-stable and fuel-resistant diaphragm with a high extensibility composed of a fluorocarbon elastomer (FCE), fluorosilicone, or nitrile butadiene rubber (NBR, HNBR). It is also advantageous to use semipermeable fabric instead of the diaphragm, for example the fabric known under the trademark Goretex®, since this guarantees that no moisture can penetrate to the inside.

DETAILED DESCRIPTION OF THE INVENTION

Figure 1:
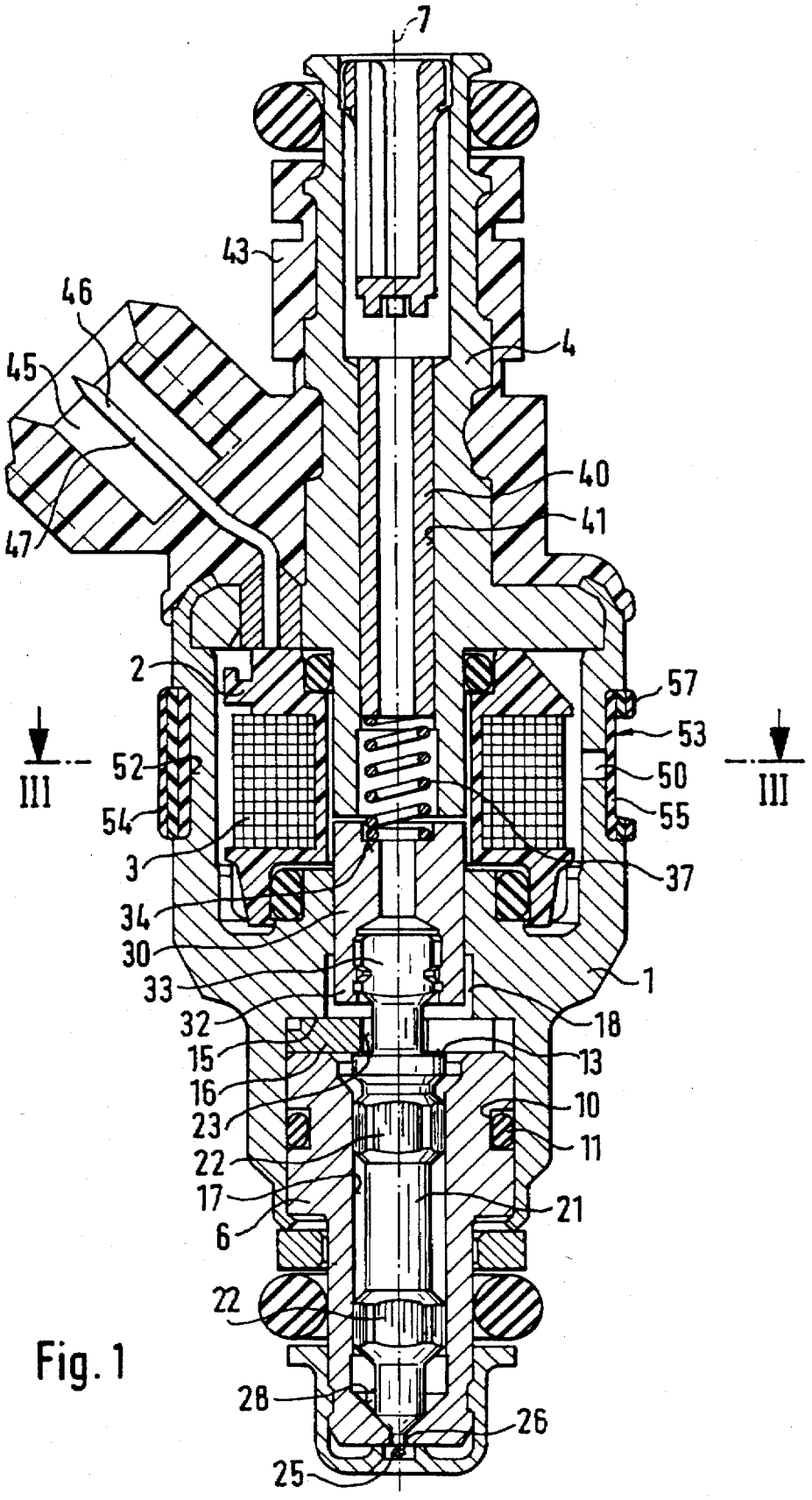
FIG. 1 shows a fuel injection valve with a first pressure compensation element according to the present invention.

The electromagnetically actuable fuel injection valve according to the present invention, depicted by way of example in FIG. 1, for fuel injection systems of internal combustion engines has a tubular valve housing 1 composed of a ferromagnetic material in which a magnet coil 3 is arranged on a coil former 2. The coil former 2 partially surrounds a stepshaped core 4 which extends concentrically to a valve longitudinal axis 7, which is of tubular design and via which the fuel is supplied. At its end remote from the magnet coil 3, the valve housing 1 partially surrounds, in the axial direction, a nozzle body 6. To provide liquid-tight sealing between the valve housing 1 and the nozzle body 6, an annular groove 10 is formed on the circumference of the nozzle body 6, a sealing ring 11 being arranged in this annular groove.

Clamped between an end face 13 of the nozzle body 6 facing the magnet coil 3 and an inner shoulder 15 of the valve housing 1, the inner shoulder lying opposite the end face 13 in the axial direction, is a stop plate 16. The stop plate 16 serves to limit the movement of a valve needle 21, which is arranged in a stepped longitudinal hole 17 with a guiding region in the nozzle body 6 and projects into a stepped longitudinal opening 18 in the valve housing 1. Two guiding sections 22 of the valve needle 21, which are, for example, designed as squares, are guided by the guiding region of the longitudinal hole 17; however, they also leave an axial passage for the fuel. The valve needle 21 projects with radial clearance through a through opening 23 in the stop plate 16 and, at its downstream end, projects by means of a needle pintle 25 from an injection opening 26 in the nozzle body 6. At the downstream end, the end remote from the stop plate 16, a seating surface 28 which is, for example, frusto-conical, is formed on the nozzle body 6. This seating surface interacts with an end of the valve needle 21, the said end serving as a valve-closing part, and effects the opening and closing of the fuel injection valve.

At its other end, the valve needle 21 is rigidly connected to a tubular armature 30. For this purpose, a region 32 of the armature 30 facing the seating surface 28 engages around a retaining part 33 of the valve needle 21. A return spring 37 rests by one end against a shoulder 34 of the armature 30, the said shoulder facing the magnet coil 3. The other end of the return spring 37 is supported against a tubular adjusting sleeve 40 which is press-fitted into a stepped through hole 41 in the core 4.

The core 4 and the valve housing 1 are at least partially surrounded in the axial direction by a plastic sheath 43. An electrical connection plug 45, by means of which the electrical contacting of the magnet coil 3 and hence its excitation is achieved, is formed, for example, together with the plastic sheath 43. The connection plug 45, which is manufactured from plastic, includes, for example, two metallic contact pins 46, these being connected directly to the winding of the magnet coil 3. The contact pins 46 project from the coil former 2 surrounding the magnet coil 3 in the direction away from the seating surface 28 and are largely surrounded by plastic. Only at their ends 47 are the contact pins 46 exposed; there, they are thus not surrounded directly by plastic, making it possible to establish a plug-in connection with a corresponding plug part (not shown).

Joints between plastic and metal parts are not completely tight. Fuel injection valves are no exception and thus it is not possible to guarantee complete tightness in the region of the contact pins 46 embedded in plastic. On the contrary, very fine capillary gaps form between the contact pins 46 and the plastic sheath 43. Particularly under the action of heat, this effect is even further increased due to the differing coefficients of thermal expansion of plastic and metal and leads to the displacement of material.

During the operation of the internal combustion engine and of the fuel injection valve, an increase in temperature in the region of the magnet coil 3 and the connection plug 45 is caused precisely by the internal combustion engine and also by the heating up of the magnet coil 3, and this increase in temperature in turn increases the formation of capillary gaps. The very fine capillary gaps ensure that direct connections exist between the air enclosed between the coil former 2 and the valve housing 1 and the atmosphere existing outside the fuel injection valve, allowing the fuel injection valve to "breathe".

It follows that a pressure compensation between the outside atmosphere and the inner air can take place as a function of the temperature. Given an increase in temperature during the operation of the fuel injection valve, the expansion in the volume of the magnet coil 3 and of the enclosed air ensures that the internal pressure is relieved to the outside via the capillary gap and a pressure equilibrium is thus maintained. During cooling, pressure compensation takes place in the opposite direction, with the result that ambient air enters the interior of the valve, high humidity of the air drawn in, in particular, being very disadvantageous. The risk that moisture will enter the interior of the fuel injection valve is particularly high when the internal combustion engine is very vulnerable to spray, as is the case, inter alia, with rear-mounted engines of motor vehicles or when the prevailing environmental conditions are extreme. Since it is possible not only for pure water to be drawn into the capillary gaps, but also for other particles to be carried along, the corrosion in the coil space may even be accelerated and destruction of the coil wire thus cannot be excluded.

According to the present invention, this problem is solved by means of at least one, for example two, transverse holes 50 introduced into the wall of the valve housing 1 in the region of axial extension of the magnet coil 3. The transverse holes 50 now perform in a quite specific manner the task of pressure compensation between the outside atmosphere and the interior of the valve, which would have a negative effect via the capillary gap. The number of transverse holes 50 depends on the specific valve configuration and thus it is also possible that more than two transverse holes 50 might be desired.

A pressure compensation element, e.g. an annular diaphragm 53 manufactured from a rubber, is pushed onto the valve housing 1 into an encircling annular groove 52 from which the transverse holes 50 extend in the direction of the magnet coil 3. In the installed position, the diaphragm 53 covers the transverse holes 50 in the valve housing 1 completely. It is not necessary for the operation of the diaphragm 53 to provide an annular groove in the circumference of the valve housing 1. The decisive point is that the transverse holes 50 should be covered by the diaphragm 53 in one way or another.

Figure 3:
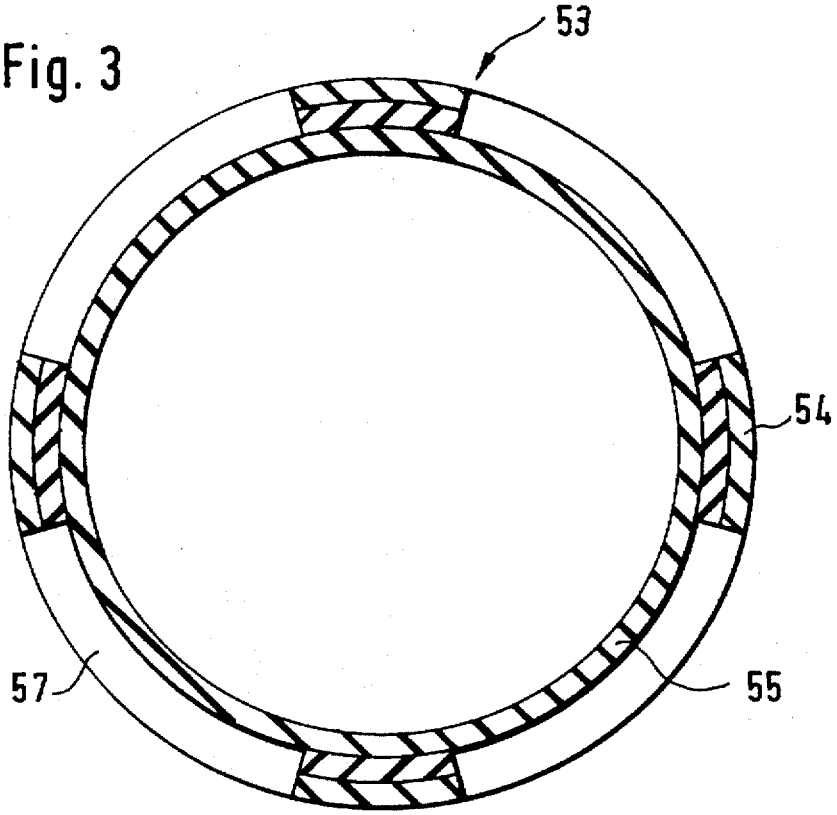
FIG. 3 shows a section view through a pressure compensation element according to the present invention along the line III—III in FIG. 1.

As shown in FIG. 3, the diaphragm 53 has alternate areas of thicker and thinner cross section. The areas of thicker cross section represent reinforcing portions 54, by means of which the strength and stiffness of the diaphragm 53 are significantly increased. There can, for example, be between one and six of these reinforcing portions 54 alternating with the areas of thinner cross section, which are designed as highly flexible diaphragm walls 55. Axially above and below the thin diaphragm walls 55, diaphragm rims 57 bounding the diaphragm 53 in ring form are provided, these rims having, for example, the same thickness as the reinforcing portions 54 and ensuring an optimum fit of the diaphragm 53 in the annular groove 52 by means of their high radial tension. One diaphragm wall 55 must cover at least one transverse hole 50 and this can be achieved easily by means of the ratio of the number of transverse holes 50 to the number of diaphragm walls 55.

The quality of the diaphragm 53 is subject to various requirements. Thus, it must have the ability to compensate for even small pressure fluctuations by its mobility. In the event of an increase in temperature and an increased internal pressure in the interior of the valve, the thin, highly flexible diaphragm walls 55 move radially outwards and rise to a minimal extent from the valve housing 1. In the event of cooling and a possible negative pressure in the interior of the valve, the diaphragm walls 55 are drawn against the valve housing 1 again or are drawn to a slight extent into the transverse holes 50. In each case, the diaphragm rims 57 provide a seal by virtue of the fact that they are in continuous airtight contact with the valve housing 1. In addition to the extensibility which is required for this purpose, the material of the diaphragm 53 must also be fuel-resistant and temperature-stable. For this reason, rubber materials, such as nitrile butadiene rubber (NBR, ENBR), fluorocarbon elastomer (FCE) or fluorosilicone are suitable for the diaphragm 53. Thus, the diaphragm 53 allows pressure compensation without the risk that moisture will penetrate into the interior of the valve and prevents negative capillary flows.

Figure 2:
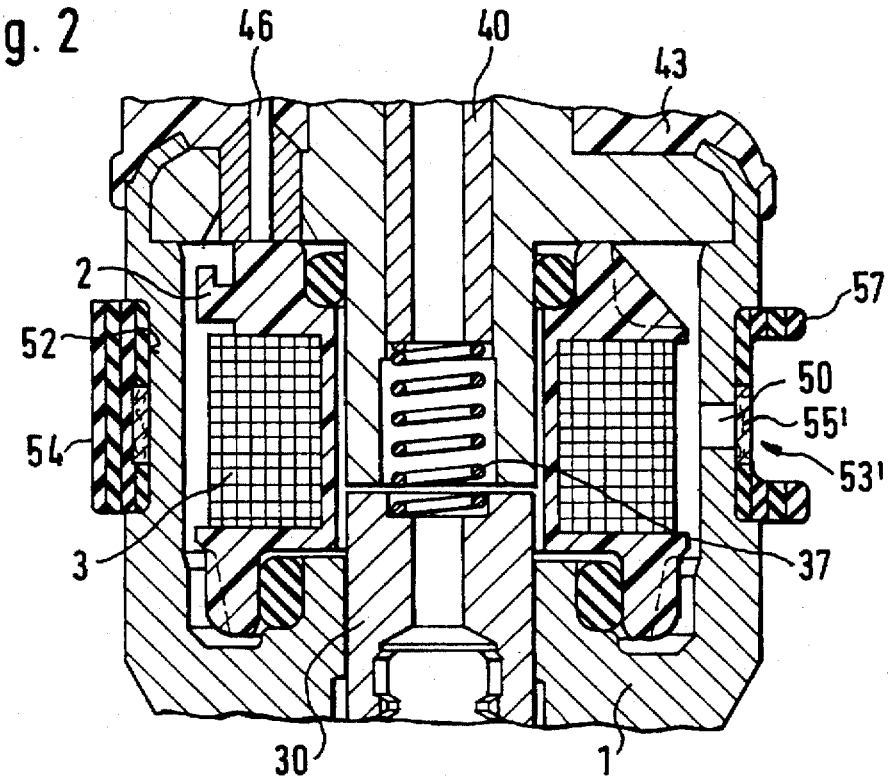
FIG. 2 shows a detail of a fuel injection valve with a second pressure compensation element according to the present invention.

FIG. 2 shows a second exemplary embodiment of a pressure compensation element covering, in accordance with the present invention, transverse holes 50. In this arrangement, the thin diaphragm walls 55 are replaced by a fabric 55' consisting of semipermeable material, e.g. the fabric known under the trademark Goretex®. The fabric 55' is inserted in such a way that it acts as a vapor barrier from the outside to the inside but can thus assume the task of carrying water vapor, for example, from the inside to the outside during the "breathing" process. A gas exchange can thus be achieved but no moisture penetrates into the interior of the valve. The semipermeable fabric 55' can be embedded in a carrier element 53' made of plastic which, for example, has the same shape as the diaphragm 53 in the first exemplary embodiment. The carrier element 53' together with the fabric 55' can be secured on the valve housing 1, for example, by clipping it into the annular groove 52. The number of transverse holes 50 and of areas of thinner cross section can again be varied.

What is claimed is:

1. An electromagnetically actuable fuel injection valve for a fuel injection system of an internal combustion engine, comprising:

a valve housing having at least one radially extending transverse hole, the at least one radially extending transverse hole containing only air;

a magnet coil arranged on a coil former, the magnet coil being at least partially disposed in the valve housing and the at least one radially extending transverse hole being in a region of an axial extension of the magnet coil;

a plastic sheath at least partially surrounding the valve housing;

an electrical connection plug coupled to the magnet coil, the electrical connection plug being composed of a plastic and having at least two contact pins for exciting the magnet coil; and an air pressure compensation element at least partially surrounding the valve housing and covering the at least one radially extending transverse hole.

2. The fuel injection valve according to claim 1, wherein the pressure compensation element includes one of a diaphragm and a fabric.

3. The fuel injection valve according to claim 1, wherein the pressure compensation element includes a ring surrounding the valve housing.

4. The fuel injection valve according to claim 1, wherein the valve housing has a second transverse hole.

5. An electromagnetically actuable fuel injection valve of an internal combustion engine, comprising:

a valve housing having at least one radially extending transverse hole;

a magnet coil arranged on a coil former, the magnet coil being at least partially closed in the valve housing and the at least one radially extending transverse hole being in a region of an axial extension of the magnet coil;

a plastic sheath at least partially surrounding the valve housing;

an electrical connection plug coupled to the magnet coil, the electrical connection plug being composed of a plastic and having at least two contact pins for exciting the magnet coil and a pressure compensation element at least partially surrounding the valve housing and covering the at least one radially extending transverse hole, wherein the pressure compensation element includes a diaphragm having at least one first cross-sectional area and at least one second cross-sectional area, the at least one first cross-sectional area alternating with the at least one second cross-sectional area in a circumferential direction, the at least one first cross-sectional area having a thickness greater than the at least one second cross-sectional area.

6. The fuel injection valve according to claim 5, wherein the at least one second cross-sectional area includes a diaphragm wall composed of a rubber material, the at least one radially extending transverse hole being covered by the diaphragm wall.

7. The fuel injection valve according to claim 6, wherein the diaphragm is composed of one of a fluorocarbon elastomer, a fluorosilicone, and a nitrile butadiene.

8. An electromagnetically actuable fuel injection valve of an internal combustion engine, comprising:

a valve housing having at least one radially extending transverse hole;

a magnet coil arranged on a coil former, the magnet coil being at least partially disposed in the valve housing and the at least one radially extending transverse hole being in a region of an axial extension of the magnet coil;

a plastic sheath at least partially surrounding the valve housing;

an electrical connection plug coupled to the magnet coil, the electrical connection plug being composed of a plastic and having at least two contact pins for exciting the magnet coil; and a pressure compensation element at least partially surrounding the valve housing and covering the at least one radially extending transverse hole, wherein the pressure compensation element includes one of a diaphragm and a fabric, the fabric including a semipermeable material.

9. An electromagnetically actuable fuel injection valve of an internal combustion engine, comprising:

a valve housing having at least one radially extending transverse hole;

a magnet coil arranged on a coil former, the magnet coil being at least partially disposed in the valve housing and the at least one radially extending transverse hole being in a region of an axial extension of the magnet coil;

a plastic sheath at least partially surrounding the valve housing;

an electrical connection plug coupled to the magnet coil, the electrical connection plug being composed of a plastic and having at least two contact pins for exciting the magnet coil; and a pressure compensation element at least partially surrounding the valve housing and covering the at least one radially extending transverse hole, wherein the pressure compensation element includes one of a diaphragm and a fabric, the fabric being embedded in a plastic annular carrier element.

10. The electromagnetically actuable fuel injection valve according to claim 1, wherein the air pressure compensation element moisture-tight seals the at least one radially extending transverse hole.

* * * * *

UNITED STATES PATENT AND TRADEMARK OFFICE

CERTIFICATE OF CORRECTION

PATENT NO. : 5,685,493

DATED : November 11, 1997

INVENTOR(S) : Uwe Grytz et al

It is certified that error appears in the above-identified patent and that said Letters Patent is hereby corrected as shown below:

On the title page, item [54] and col 1. the title should read:

--Electromagnetically Actuable Fuel Injection Valve--;

Col. 5, line 37, "closed" should be --disposed--; and

Col. 5, line 45, after "coil" insert --;--.

Signed and Sealed this

Fifth Day of May, 1998

Bruce Lehman

*Attest:*

BRUCE LEHMAN

*Attesting Officer*

*Commissioner of Patents and Trademarks*